US006508420B2

(12) United States Patent
Strasser et al.

(10) Patent No.: US 6,508,420 B2
(45) Date of Patent: Jan. 21, 2003

(54) METHOD AND DEVICE FOR TWO-STAGE CLASSIFICATION OF GRANULAR MATERIAL

(75) Inventors: Siegfried Strasser, Much (DE); Albert Süssegger, Eitorf (DE)

(73) Assignee: KHD Humboldt Wedag, AG, Cologne (DE)

( * ) Notice: Subject to any disclaimer, the term of this patent is extended or adjusted under 35 U.S.C. 154(b) by 22 days.

(21) Appl. No.: 09/798,685

(22) Filed: Mar. 2, 2001

(65) Prior Publication Data

US 2001/0020654 A1 Sep. 13, 2001

(30) Foreign Application Priority Data

Mar. 3, 2000 (DE) ..... 100 10 406

(51) Int. Cl.[7] ..... B02C 23/14
(52) U.S. Cl. ..... 241/24.1; 209/3; 241/80
(58) Field of Search ..... 209/3; 241/29, 241/24.1, 80, 97, 152.2

(56) References Cited

U.S. PATENT DOCUMENTS 4,784,333 A * 11/1988 Hikake et al. ..... 241/19
5,897,063 A * 4/1999 Patzelt et al. ..... 241/152.2

FOREIGN PATENT DOCUMENTS

DE 19526040 1/1997
EP 0650763 12/1998

* cited by examiner

*Primary Examiner*—Mark Rosenbaum
(74) *Attorney, Agent, or Firm*—Charles L. Schwab; Nexsen Preut Jacobs & Pollard, LLC

(57) ABSTRACT

Two-stage classification of a granular material, in particular a cement grinding feed, is accomplished in two classifiers connected in series in such a way that the separative behavior or the separative action and thus the particle-size distribution of the undersized or finished material coming from the second classifier can be modified with simple resources. Part or all of the oversized material of the second classifier is recycled to the second classifier.

12 Claims, 1 Drawing Sheet

METHOD AND DEVICE FOR TWO-STAGE CLASSIFICATION OF GRANULAR MATERIAL

TECHNICAL FIELD

This invention relates to a method for two-stage classification of a granular material, which is separated in a first classifier into a first oversized material and a first undersized material, the latter of which is separated in a second classifier into a second oversized material and a second undersized material. The invention further relates to a device for the performance of the method.

BACKGROUND OF THE INVENTION

German patent document DE-A-195 26 040 issued Jan. 23, 1997 to L. Kimmeyer for a Method and Device for Commination of Ground Stock describes a two-stage classification of a granular material, namely a cement grinding feed generated in a mill, which is classified in a first classifier into a first oversized material and a first undersized material. The first undersized material is then classified in a second classifier into a second oversized material and a second undersized material, that is, the finished fine cement. The oversized material from the first classifier is recycled in closed circuit to the mill, which can be a roller mill with autogenous size reduction, a roll mill, a ring mill, or another size-reduction machine. The second oversized material from the second classifier is recycled to the material inlet of the first classifier. The second classifier receives at most, in any case, only that quantity of undersized material from the first classifier that is left as undersized material, according to the particle-size distribution of the fresh feed material and the setting of the separation limit of the first classifier. It is thus possible for the second classifier to experience operating conditions in which the second classifier receives too small a quantity of undersized material as feed material from the first classifier, so that the feed loading of the second classifier declines to the extent that an excessively high sharpness of separation comes about in the second classifier, resulting in a steep gradation curve or a narrow particle-size distribution, which would not be desired, at least for the product cement.

European patent EP 0650763B1 issued Oct. 6, 1994 to H. Sussegger for a Closed Circuit Grinding Plant discloses two classifiers connected in series, in which a classifying air stream laden with an intermediate/undersize fraction from the first classifier is inlet to a second classifier for the purpose of further classification. The problem of unsuitable feed loading and thus of the unsuitable sharpness of separation in the second classifier does not arise, because a separate mill is assigned to the second classifier, the discharge material of which mill is likewise inlet to the second classifier.

OBJECTS AND SUMMARY OF THE INVENTION

It is an object of the invention to develop the two-stage classification of a granular material, in particular of a cement grinding feed, in two classifiers connected in series, in such a way that the separative behavior or the separative action and thus the particle-size distribution of the undersized material coming from the second classifier, which is normally the finished material, can be modified with simple resources.

Characteristic for the two-stage classification of a granular material according to the invention is that the oversized material from the second classifier is not, as is otherwise common, recirculated to the material inlet of the first classifier and/or to the mill, but part or all of the oversized material from the second classifier is again fed to the second classifier in closed circuit. Accordingly, the feed loading and thus the separative behavior of the second classifier are set via the quantity of oversized material recirculated to the second classifier in such a way that a second undersized material, as a rule the finished product having the desired particle-size distribution, can be withdrawn therefrom. Thus, in order to broaden the particle-size distribution of the second undersized material (finished material) or to make the gradation curve flatter, the quantity of recirculated oversized material from the second classifier is increased. Furthermore, the recirculation of at least a substream of the second oversized material from the second classifier back into this classifier increases the residence time of this material in the second classifier, which has a beneficial effect for the drying of moist classifier feed when hot gas is employed as classifying air.

The above-described controllable feed loading of the second classifier according to the invention can also be automated by a control action on the quantity of oversized material recirculated to the second classifier in dependence on the steepness of the gradation curve of the finished material or the feed loading of the second classifier.

BRIEF DESCRIPTION OF THE DRAWING

The invention and further features and advantages of the invention are explained in more detail on the basis of the exemplary embodiment illustrated schematically in the drawing.

DETAILED DESCRIPTION OF THE INVENTION

Figure 1:
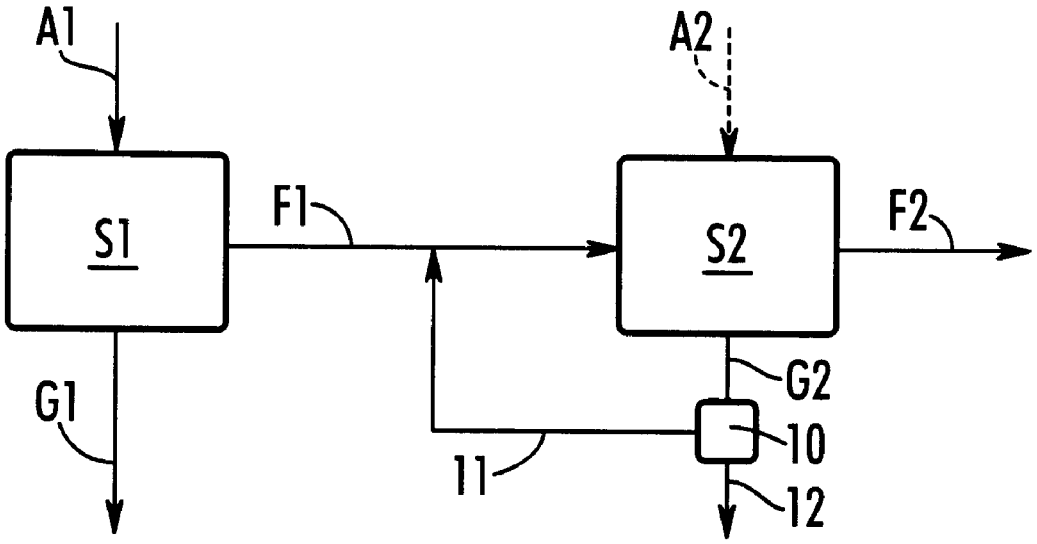

The drawing shows schematically the two-stage classification of a granular feed material A1, which can be, for example, ground cement raw meal, ground cement clinker or the like. The granular material A1 is first separated in a first classifier S1 into a first oversized material G1 and a first undersized material F1, which later is separated in a second classifier S2 into a second oversized material G2 and a second undersized material F2, as a rule the finished material. In cement grinding, the Blaine fineness of the undersized material F2 discharged from the second classifier S2 is to be, for example, greater than 3000 $cm^2/g$.

Arranged in the material discharge of the second oversized material G2 from the second classifier S2 is a material quantity splitter 10, to which is connected a recirculation line or conveying device for the recycling of at least a substream 11 of the second oversized material G2 to the second classifier S2, that is, part or all of the oversized material G2 of the second classifier S2 can be fed again to the second classifier S2 together with the undersized material F1 of first classifier S1. The transport of undersized material F1 from the first classifier S1 to the second classifier S2 can be effected either pneumatically, with the classifying air, or mechanically. In either case, the feed loading and thus the separative behavior of the second classifier S2 and, in connection therewith, the particle-size distribution of the finished material can be controlled through the quantity of recirculated oversized material 11 from the second oversized material G2 of the second classifier S2. Further, the internal recirculation of material through second classifier S2 increases the material residence time, which has a beneficial effect for the drying of possibly moist material.

Substream 12 of the oversized material G2 not recycled to the second classifier S2 can be a separate grinding product, or "intermediate material" delivered to the first oversized material the first classifier S1 and/or to the material feed to the first classifier S1 and/or also to in the milling circuit of the first classifier S1.

The Blaine fineness of the first undersized material F1 from the first classifier S1 can be, for example, greater than 800 $cm^2/g$, and the mean Blaine fineness of substream 11 of the second oversized material G2 recycled to the second classifier S2 can be, for example, about 500

It is also possible to feed to the second classifier S2, in addition to the first undersized material F1 from the first classifier S1 and the recirculated substream oversized material 11, an al feed material A2, so that the feed loading in the second classifier S2 and the particle-size distribution of finished material F2 can likewise be controlled.

What is claimed is:

1. A method for two-stage classification of a granular material (A1), comprising the steps of:

separating said granular material (A1) in a first classifier (S1) into a first oversized material (G1) and a first undersized material (F1);

separating said first undersized material (F1) by passing it directly to a second classifier (S2) which separates said first undersized material (F1) into a second oversized material (G2) and a second undersized material (F2); and recycling at least a substream (11) of said second oversized material (G2) from said second classifier (S2) to said second classifier (S2) without passing said substream (11) through said first classifier (S1).

2. The method as set forth in claim 1 including the step of combining a substream (12) of said second oversized material (G2) not recycled to said second classifier (S2) with said first oversized material (G1) from said first classifier (S1).

3. The method as set forth in claim 1 including the step of delivering to said first classifier (S1) a substream (12) of said second oversized material (G2) not recycled to said second classifier (S2).

4. The method as set forth in claim 1 wherein said first classifier (S1) receives said granular material from a milling circuit which includes a mill and further comprising the step of delivering to said mill a substream (12) of said second oversized material (G2) not recycled to said second classifier (S2).

5. The method as set forth in claim 1 wherein the Blaine fineness of said first undersized material (F1) from said first classifier (S1) is greater than 800 $cm^2/g$.

6. The method to as set forth in claim 5 wherein the mean Blaine fineness of said substream (11) of said second oversized material (G2) recycled to said second classifier (S2) is greater than 500 $cm^2/g$.

7. The method as set forth in claim 6 wherein the Blaine fineness of said second undersized material (F2) from said second classifier (S2) is greater than 3000 $cm^2/g$.

8. The method of claim 1 wherein the mean Blaine fineness of said substream (11) of said second oversized material (G2) recycled to said second classifier (S2) is greater than 500 $cm^2/g$.

9. The method of claim 8 wherein the mean Blaine fineness of said second undersized material (F2) is greater than 3000 $cm^2/g$.

10. The method set forth in claim 1 including the step of feeding an additional feed material (A2) to said second classifier (S2).

11. The method as set forth in claim 1 including the step of delivering drying gas to said second classifier (S2).

12. A device for the classification of a granular material comprising:

a first classifier (S1) operable to separate said granular material into a first oversized material (G1) and a first undersized material (F1);

a second classifier (S2) receiving said first undersized material (F1) directly from said first classifier (S1) and operable to separate said first undersized material (F1) into a second undersized material (F2) and a second oversized material (G2);

a material quantity splitter (10) receiving said second oversized material (G2) directly from said second classifier (S2); and a conveying device connected to said splitter (10) operable to recycle a substream (11) of said second oversized material (G2) directly to said second classifier (S2).

* * * * *